US011087968B2

(12) United States Patent
Schell et al.

(10) Patent No.: US 11,087,968 B2
(45) Date of Patent: Aug. 10, 2021

(54) TRAVELING WAVE MULTIPOLE

(71) Applicant: Thermo Finnigan LLC, San Jose, CA (US)

(72) Inventors: David A. Schell, Round Rock, TX (US); Joshua T. Maze, Round Rock, TX (US)

(73) Assignee: THERMO FINNIGAN LLC., San Jose, CA (US)

( * ) Notice: Subject to any disclaimer, the term of this patent is extended or adjusted under 35 U.S.C. 154(b) by 46 days.

(21) Appl. No.: 16/704,866

(22) Filed: Dec. 5, 2019

(65) Prior Publication Data

US 2020/0194249 A1 Jun. 18, 2020

Related U.S. Application Data

(60) Provisional application No. 62/779,681, filed on Dec. 14, 2018.

(51) Int. Cl.
*H01J 49/42* (2006.01)
*H01J 49/06* (2006.01)

(52) U.S. Cl.
CPC ..... *H01J 49/42* (2013.01); *H01J 49/065* (2013.01); *H01J 49/429* (2013.01); *H01J 49/4235* (2013.01); *H01J 49/4285* (2013.01)

(58) Field of Classification Search
CPC ..... H01J 49/42; H01J 49/065; H01J 49/421; H01J 49/4235; H01J 49/4285; H01J 49/429
USPC ..... 250/292, 290, 281, 282
See application file for complete search history.

(56) References Cited

U.S. PATENT DOCUMENTS

| | | | | |
|---|---|---|---|---|
| 6,838,662 | B2 | 1/2005 | Bateman et al. | |
| 7,034,292 | B1 | 4/2006 | Whitehouse et al. | |
| 7,189,967 | B1 | 3/2007 | Whitehouse et al. | |
| 8,426,803 | B2 | 4/2013 | Green et al. | |
| 8,581,177 | B2 | 11/2013 | Kovtoun | |
| 2014/0191123 | A1* | 7/2014 | Wildgoose ..... | H01J 49/161 250/282 |
| 2015/0034814 | A1* | 2/2015 | Brown ..... | H01J 49/40 250/282 |
| 2019/0157065 | A1 | 5/2019 | Stewart | |

OTHER PUBLICATIONS

Bier, M.E., "Coupling ESI and MALDI Sources to the Quadrupole Mass Filter, Quadrupole Ion Trap, Linear Quadrupole Ion Trap, and Orbitrap Mass Analyzers"; in "Electrospray and MALDI Mass Spectrometry", R.B. Cole (Ed.). doi:10.1002/9780470588901 .ch9, 2010, pp. 265-344.

* cited by examiner

*Primary Examiner* — Kiet T Nguyen
(74) *Attorney, Agent, or Firm* — David A. Schell

(57) ABSTRACT

A traveling wave multipole comprising two or more pairs of segmented electrodes arranged around a central axis; and a voltage supply. The voltage supply configured to supply the segments of each pair of electrodes with a different RF and DC potential; and match RF and DC potentials with a location of an ion of target m/z moving through the traveling wave multipole such that as the ion travels along the multipole the ion experiences the same RF and DC potentials while another ion of a second target m/z concurrently experiences a different RF and DC potentials at another location within the traveling wave multipole.

19 Claims, 10 Drawing Sheets

TRAVELING WAVE MULTIPOLE

FIELD

The present disclosure generally relates to the field of mass spectrometry including a traveling wave multipole.

INTRODUCTION

Quadrupole mass analyzers are one type of mass analyzer used in mass spectrometry. As the name implies, a quadrupole consists of four rods, usually cylindrical or hyperbolic, set in parallel pairs to each other, as for example, a vertical pair and a horizontal pair. These four rods are responsible for selecting sample ions based on their mass-to-charge ratio (m/z) as ions are passed down the path created by the four rods. Ions are separated in a quadrupole mass filter based on the stability of their trajectories in the oscillating electric fields that are applied to the rods. Each opposing rod pair is connected together electrically, and a radio frequency (RF) voltage with a DC offset voltage is applied between one pair of rods and the other. Ions travel down the quadrupole between the rods. Only ions of a certain mass-to-charge ratio will be able to pass through the rods and reach the detector for a given ratio of voltages applied to the rods. Other ions have unstable trajectories and will collide with the rods. This permits selection of an ion with a particular m/z or allows the operator to scan for a range of m/z-values by continuously varying the applied voltage.

By setting stability limits via applied RF and DC potentials that are capable of being ramped as a function of time, such instruments can be operated as a mass filter, such that ions with a specific range of mass-to-charge ratios have stable trajectories throughout the device. In particular, by applying fixed and/or ramped AC and DC voltages to configured cylindrical but more often hyperbolic electrode rod pairs in a manner known to those skilled in the art, desired electrical fields are set-up to stabilize the motion of predetermined ions in the x and y dimensions. As a result, the applied electrical field in the x-axis stabilizes the trajectory of heavier ions, whereas the lighter ions have unstable trajectories. By contrast, the electrical field in the y-axis stabilizes the trajectories of lighter ions, whereas the heavier ions have unstable trajectories. The range of masses that have stable trajectories in the quadrupole and thus arrive at a detector placed at the exit cross section of the quadrupole rod set is defined by the mass stability limits.

Since quadrupoles need to scan over a mass range rather than analyzing ions across the mass range simultaneously, increasing the scan rate can be desirable.

SUMMARY

[Update with New Claims]

DRAWINGS

For a more complete understanding of the principles disclosed herein, and the advantages thereof, reference is now made to the following descriptions taken in conjunction with the accompanying drawings, in which.

Figure 1:
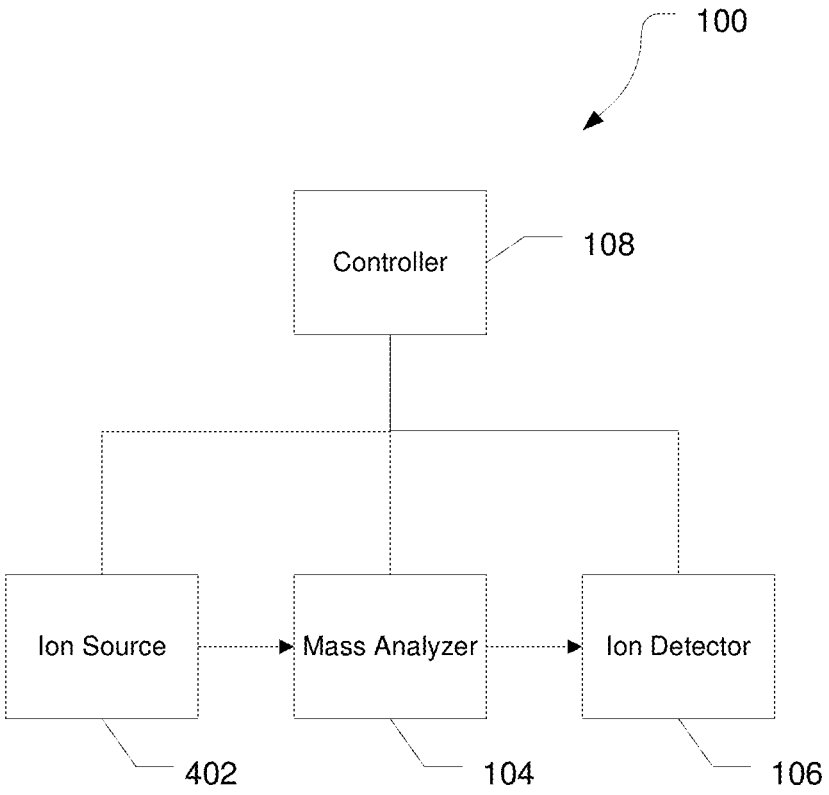
FIG. 1 is a block diagram illustrating an exemplary mass spectrometry system.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for transporting ions are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, inductively coupled plasma (ICP) source, electron ionization source , photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a time-of-flight (TOF) analyzer, a quadrupole ion trap analyzer, an electrostatic trap (e.g., Orbitrap) mass analyzer, and the like. In various embodiments, the mass analyzer 104 can also be configured to fragment the ions and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configured the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Traveling Wave Multipole

Figure 2:
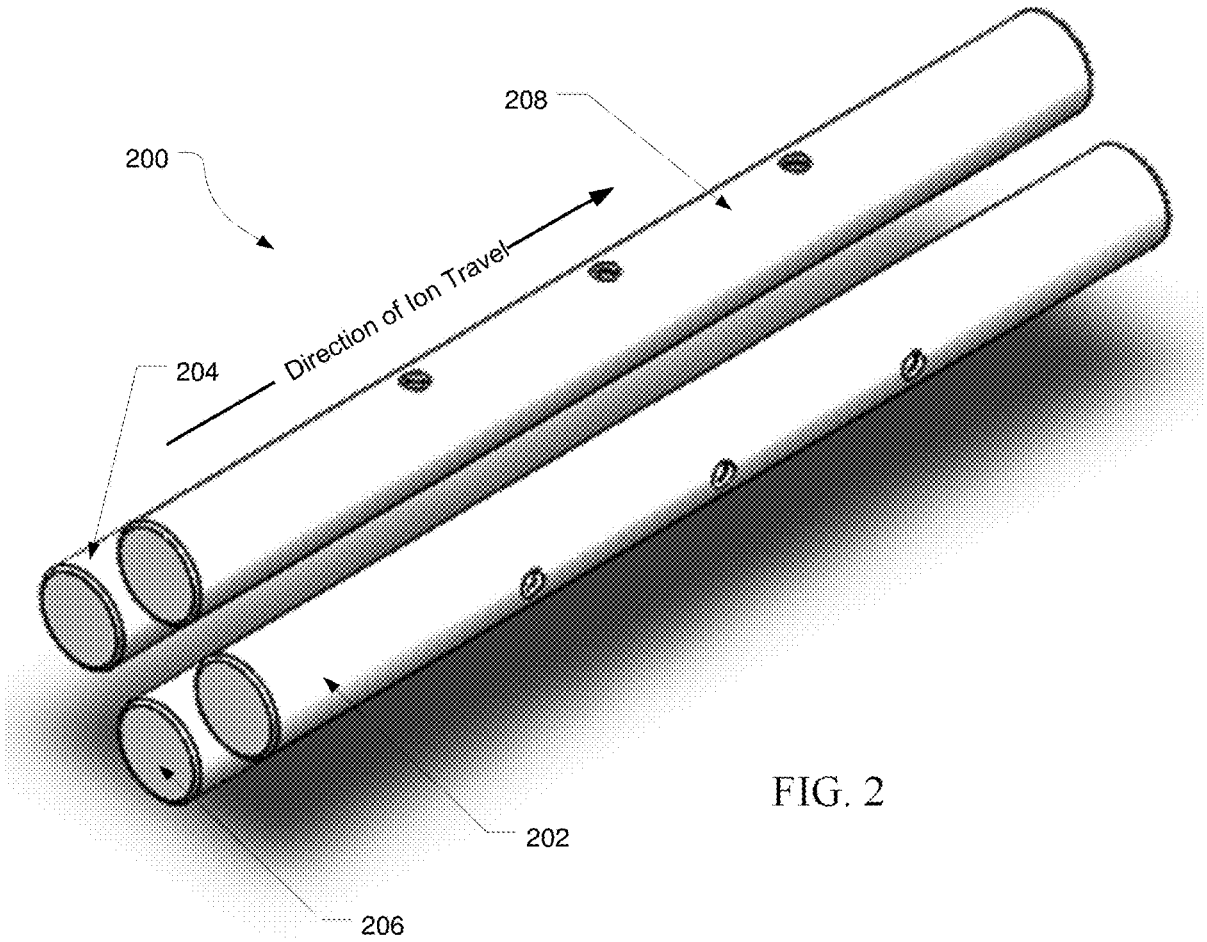
FIGS. 2 is an illustration of an exemplary quadrupole device.

As illustrated in FIG. 2, a multipole device 200 comprises four parallel electrodes (electrodes 202, 204, 206, and 208), arranged as two opposing pairs of electrodes (electrodes 202 and 204 and electrodes 206 and 208). In other embodiments, a multipole can include additional pairs of electrodes, such as a hexapole (6 electrodes in 3 pairs), and octapole (8 electrodes in 4 pairs), a dodecapole (12 electrodes in 6 pairs), and other higher order multipoles. Generally, the pairs of rod electrodes have applied to them opposite phases of radio-frequency (RF) voltage and optionally DC voltage. Mass-selective quadrupoles generally have RF and DC applied to the electrodes, whereas multipoles acting as collision cells or ion guides typically have RF only applied. However, certain multipoles devices may have only static voltages applied to them, for instance for beam shaping or an array of static lenses. The electrodes can have a circular, elliptical or hyperbolic cross-section. Alternatively, the electrodes can have a rectangular cross-section and are referred to as flat rod electrodes, in a configuration referred to as a flatapole or square multipoles. The flat rod electrodes can have bevelled or straight edges. In all cases, the rods are elongated and the ions travel along the direction of electrode elongation. Typically, the electrodes in one multipoles device are orientated in a plane perpendicular to the ions' direction of travel in the same way as those of another multipoles device.

Figure 3:
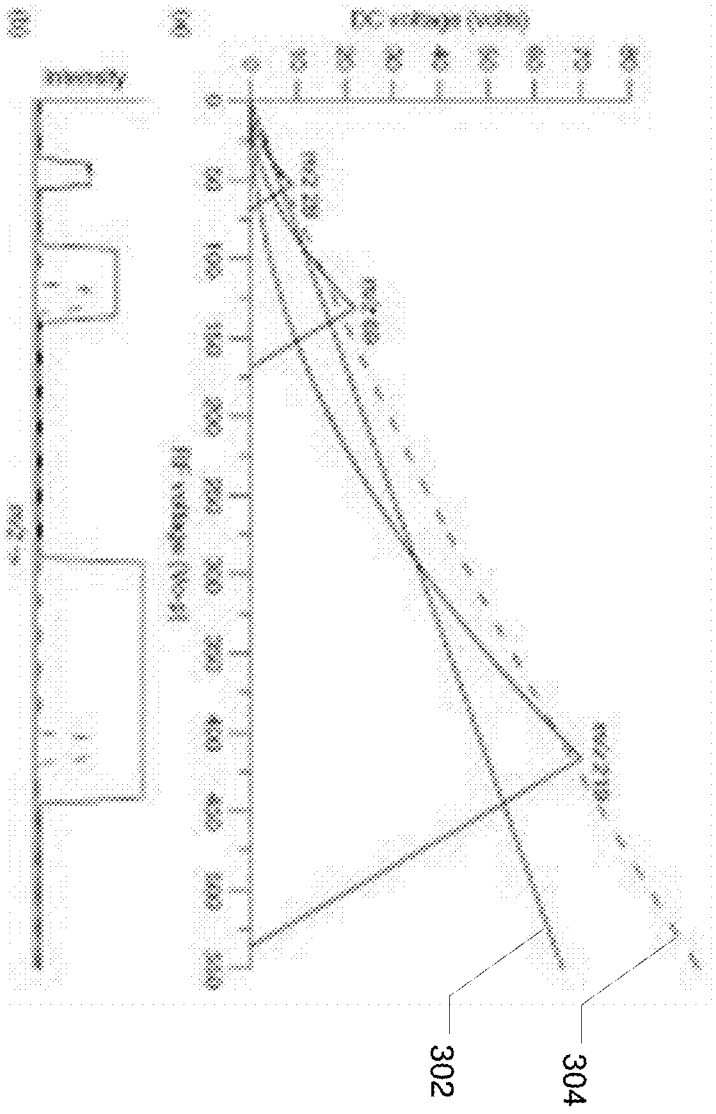
FIGS. 3 is a graph illustrating the operation of a quadrupole mass filter, in accordance with various embodiments.

The Mathieu stability diagram, as illustrated in FIG. 3, illustrates the relationship between the RF amplitude, the DC voltage, and the stability of ions of different mass to charge ratios (m/z) within the quadrupole. Ions can be transmitted through the quadrupole when the RF amplitude and DC voltage are within the stable oscillation region corresponding to the m/z of the ion. When the RF amplitude or DC voltage are outside of the stable oscillation region for the ion, the ion can be ejected from the quadrupole.

In various embodiments, the RF amplitude and DC voltage can be scanned, such as along line 302 to sequentially transmit ions of increasing (or decreasing) m/z. The resolution at a particular m/z can depend how close to the peak of the stability oscillation region the RF amplitude and DC voltage are. As such, scanning along line 304 can have increased resolution compared to line 302. However, for successful transmission, the RF amplitude and the DC voltage need to remain within the stable oscillation region during the entire transit of the ion. If the RF amplitude and the DC voltage shift outside of the of the stable oscillation region while the ions are in transit through the multipole, the ion path may become unstable and the ions may be ejected from the multipole. As such, the ion transit time imposes a limit on the resolution and scan rate. Specifically, $$T_{Transit} \geq \frac{\text{Resolution}}{ScanRate}$$

where $T_{Transit}$ is the time it takes the ion to transit the length of the multipole. Otherwise, an ion travelling through the multipole will not remain in the stable region throughout the trip and can be ejected from the multipole.

Figure 4A:
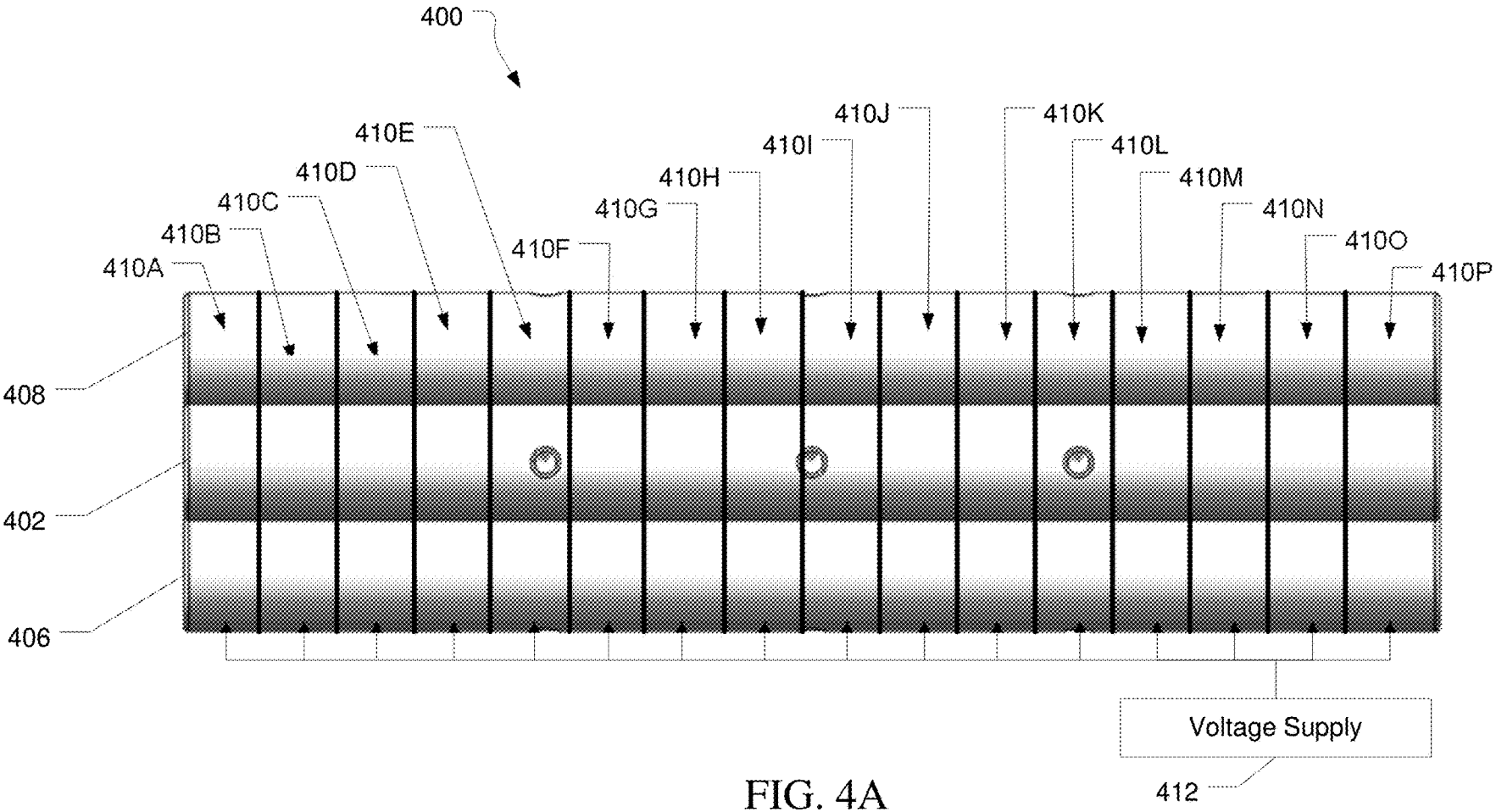
FIG. 4A is an illustration another exemplary quadrupole device, in accordance with various embodiments.

FIG. 4A shows a traveling wave multipole 400. Electrodes 402, 404 (not pictured), 406, and 408 are divided into segments (410A-410P). In other embodiments, a multipole can include additional pairs of segmented electrodes, such as a hexapole (6 segmented electrodes in 3 pairs), and octapole (8 segmented electrodes in 4 pairs), a dodecapole (12 segmented electrodes in 6 pairs), and other higher order multipoles. Each region can be provided with a different set of RF and DC potentials. By adjusting the RF and DC potentials of the segments, using voltage supply 412, so that a set of RF and DC potentials moves across the segments at the same rate as an ion moves through the traveling wave multipole 400, an ion can see the same RF and DC potentials during the entire transit, even as a trailing ion may a different set of RF and DC potentials. In this way, the scan rate and resolution of the traveling wave multipole can be increased beyond the limit imposed by the transit time.

In various embodiments, the RF and DC potentials can be scanned across a mass range, with each subsequent segment delayed proportionally to the time required for an ion to move the distance between segments.

Figure 4B:
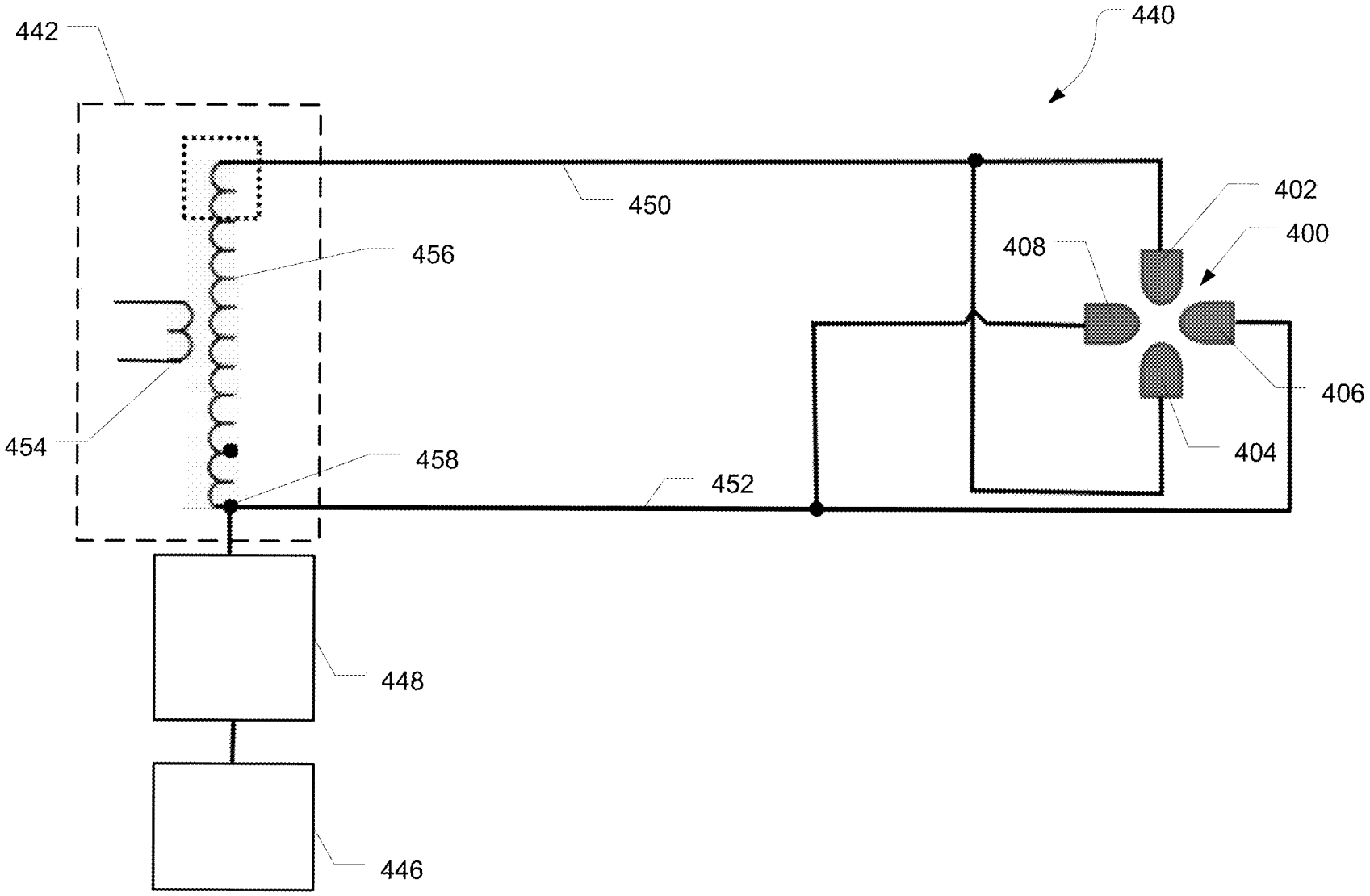
FIG. 4B is a diagram illustrating an exemplary voltage supply circuitry for an exemplary quadrupole device, in accordance with various embodiments.

FIG. 4B illustrates an exemplary voltage supply circuitry 440. Circuitry 440 can include a main RF transformer 442, an auxiliary transformer 444, a DC supply 446, and a low pass filter 448. The main RF transformer 442 can supply the main RF to multiple electrodes 402 and 404 through electrical path 450, and the auxiliary transformer 444 can supply the auxiliary RF potential to electrodes 406 and 408 through electrical paths 452 and 454 respectively. DC supply 446 can provide a DC bias voltage to electrodes 402, 404, 406, and 408. Low pass filter 448 can filter high frequency electrical noise from the DC power supply that can affect the ions within the multipole 400.

RF transformer 442 can include a primary winding 454 to supply a main RF waveform, and a secondary winding 456 to generate the required voltage for the main RF potential. Electrodes 402 and 404 can be fed from the same electrical path 450 such that main RF potential on electrodes 402 and 404 are in phase. Electrodes 406 and 408 can be fed from electrical path 452 from tap 458 such that main RF potential on electrodes 406 and 408 are in phase. As electrical path 450 and 458 and are on opposite sides of the transformer, the RF potential provided to electrodes 402 and 404 is 180 degree out of phase with the RF potential provided to electrode 406 and 408.

In various embodiments, voltage supply 412 can include multiple voltage supply circuitries, such as voltage supply circuitry 440. Each voltage supply circuitry can be coupled to a segment of the traveling wave multipole. In this way, the RF and DC potentials supplied to each segment can be independent of one another.

Figure 5A:
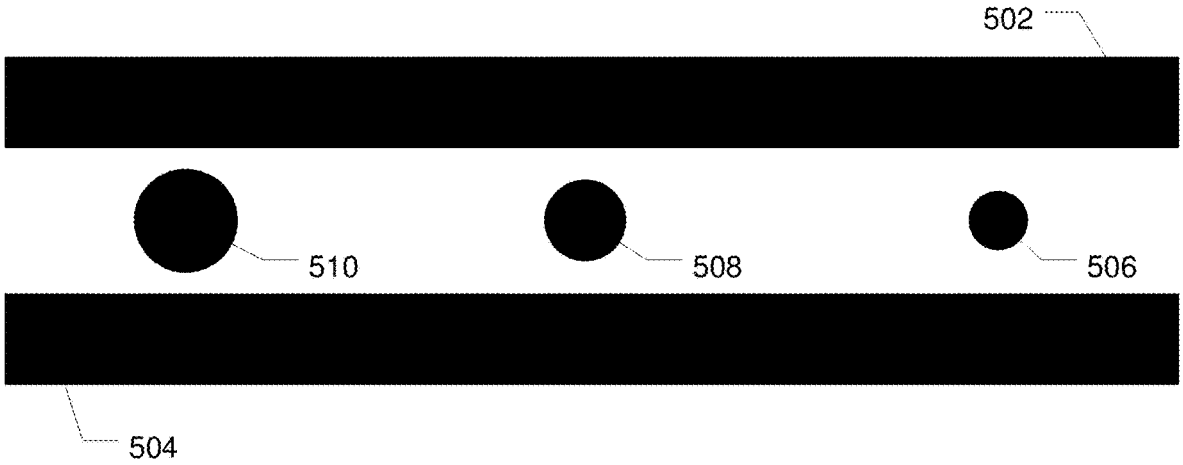
FIG. 5A is a diagram illustrating the operation of a traveling wave quadrupole in a scanning mode, in accordance with various embodiments.

FIG. 5A illustrates the RF and DC potentials of the segments when scanning across a mass range. Electrodes 502 and 504 (only 2 electrodes are depicted for clarity) are depicted showing a range of RF/DC potentials across the segments. Ion 506 can be stably transmitted across the quadrupole only in the region of corresponding RF/DC potentials. Later, ion 508 can be stably transmitted across the quadrupole in the region of corresponding RF/DC potentials for ion 508, and still later, ion 510 can be stably transmitted with yet another region of RF/DC potentials corresponding to the stability region of ion 510.

Figure 5B:
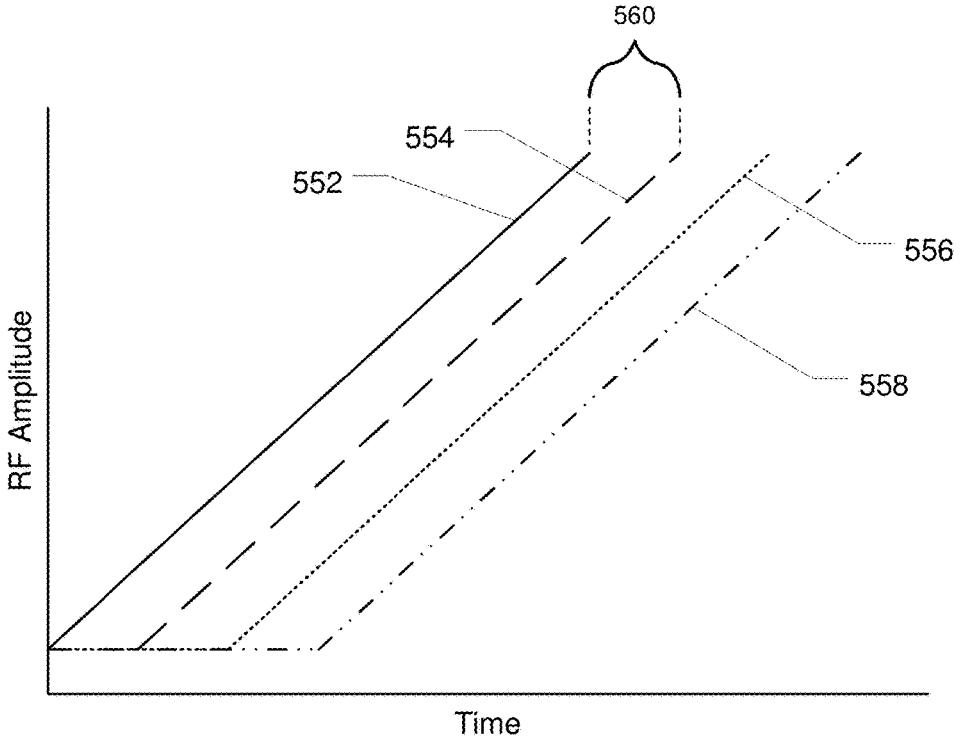
FIG. 5B is a graph illustrating the scanning of various segments of a traveling wave quadrupole, in accordance with various embodiments.

FIG. 5B illustrates the RF amplitudes of the 4 segments as a function of time while scanning a mass range. Line 552 can represent the RF amplitude of a first segment, such as segment 410A of FIG. 4. Line 554 can represent the RF amplitude of a second segment, such as segment 410B of FIG. 4. Line 556 can represent the RF amplitude of a third segment, such as segment 410C of FIG. 4. Line 558 can represent the RF amplitude of a fourth segment, such as segment 410D of FIG. 4. Bracket 560 can represent the delay between the first and second segments, which can be equivalent to the time it takes for an ion to move from the first segment to the second segment.

In various embodiments, it can be necessary to adjust the delay as a function of mass to compensate for changes in velocity due to the mass of the ion. Alternative, the kinetic energy of the ions can be adjusted to maintain a fixed velocity regardless of mass. For example voltages of upstream ion optics (such as an ion lens) can be adjust in coordination with the ramping RF and DC potentials to compensate for velocity differences due to increasing mass.

Figure 6:
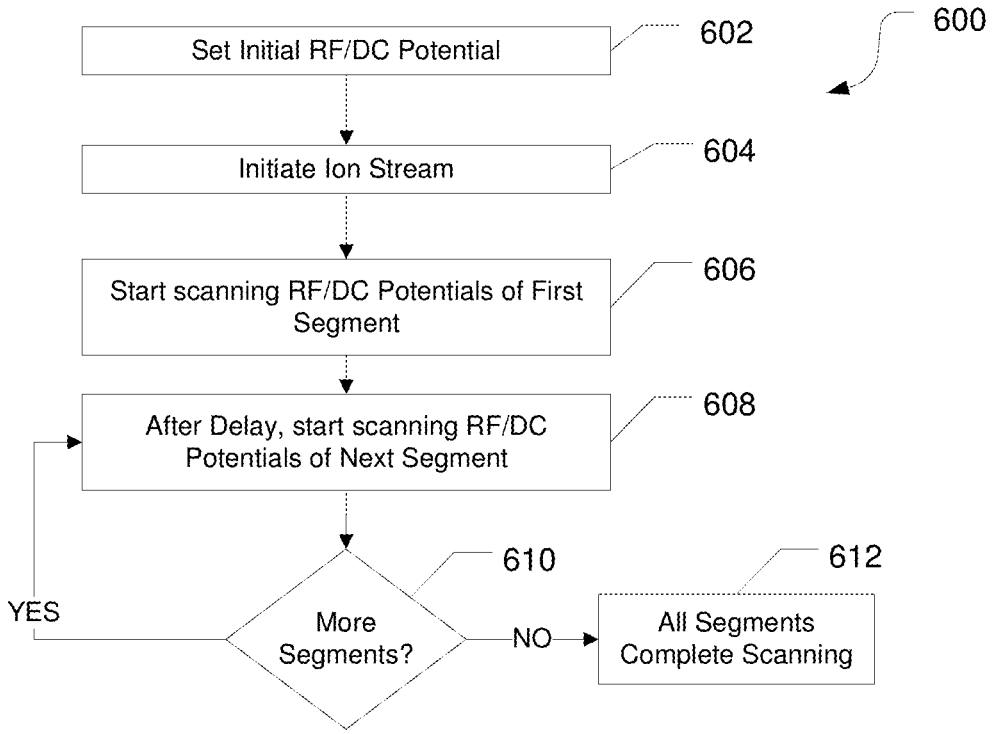
FIG. 6 is a flow diagram illustrating an exemplary method of scanning a mass range using a traveling wave quadrupole, in accordance with various embodiments.

FIG. 6 illustrates a method 600 scanning a mass range. At 602, the RF and DC potentials can be set to an initial value for all of the segments. At 604, an ion stream can be initiated. At 606, scanning of the RF and DC potentials of the first segment can begin. At 608, after a delay equivalent to the time required for ions to traverse the distance between segments, scanning of the RF and DC potentials of the second segment can begin. At 610, if there are additional segments, the method can return to 608 to begin scanning the RF and DC potentials of a subsequent segment after another delay. If there are no additional segments, all segments can complete scanning at 612.

In various embodiments, rather than scanning across a mass range, particular m/z values may be targeted, such as in a selected ion monitoring (SIM) mode or selected reaction monitoring (SRM) mode. The RF and DC potentials of a particular segment may jump from one set of values for a first m/z to a second set of values for a second m/z. Each segment may have the same shifts in the RF and DC potentials, but subsequent segments can be delayed proportionally to the time required for an ion to move the distance between segments.

Figure 7A:
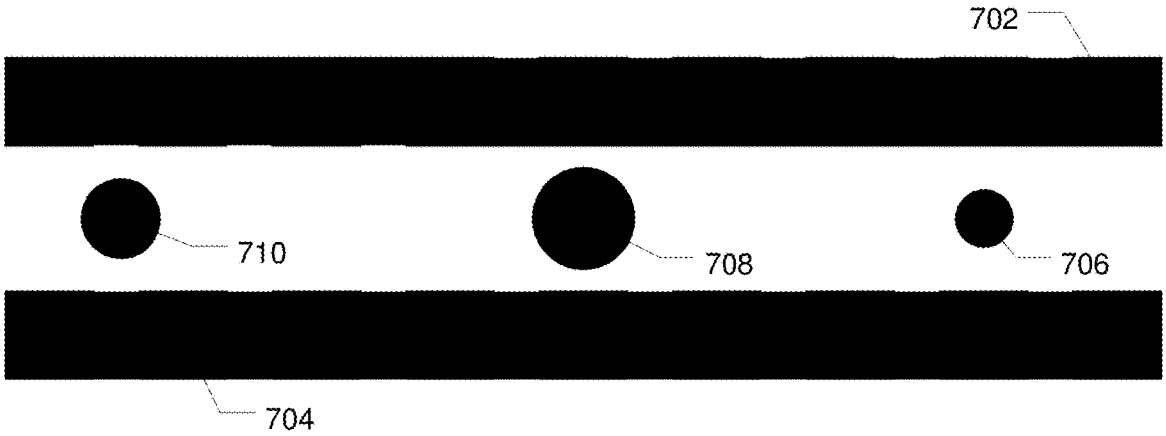
FIG. 7A is a diagram illustrating the operation of a traveling wave quadrupole in selected ion monitoring (SIM) or selected reaction monitoring (SRM) mode, in accordance with various embodiments.

FIG. 7A illustrates the RF and DC potentials of the segments when in SIM or SRM mode. Electrodes 702 and 704 (only 2 electrodes are depicted for clarity) are depicted showing different regions targeting different selected m/z targets. Ion 706 can be stably transmitted across the quadrupole only in the region of corresponding RF/DC potentials. Later, ion 708 can be stably transmitted across the quadrupole in the region of corresponding RF/DC potentials for ion 708, and still later, ion 710 can be stably transmitted with yet another region of RF/DC potentials corresponding to the stability region of ion 710.

Figure 7B:
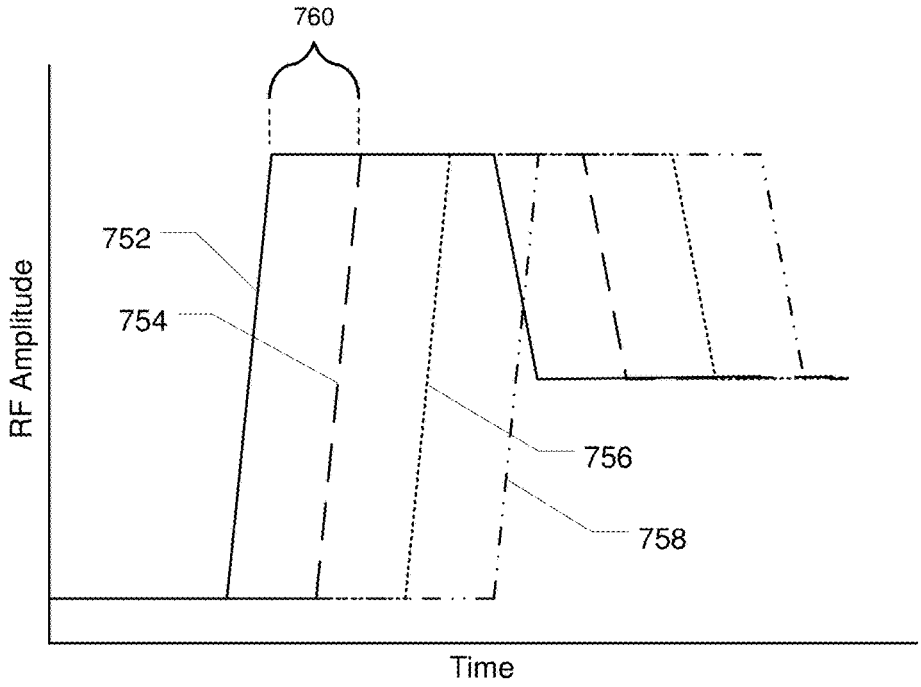
FIG. 7B is a graph illustrating SIM or SRM mode of a traveling wave quadrupole, in accordance with various embodiments.

FIG. 7B illustrates the RF amplitudes of the 4 segments as a function of time while jumping RF and DC potentials between mass targets. Line 752 can represent the RF amplitude of a first segment, such as segment 410A of FIG. 4. Line 754 can represent the RF amplitude of a second segment, such as segment 410B of FIG. 4. Line 756 can represent the RF amplitude of a third segment, such as segment 410C of FIG. 4. Line 758 can represent the RF amplitude of a fourth segment, such as segment 410D of FIG. 4. Bracket 760 can represent the delay between the first and second segments, which can be equivalent to the time it takes for an ion to move from the first segment to the second segment.

In various embodiments, it can be necessary to adjust the delay as a function of mass to compensate for changes in velocity due to the mass of the ion. Alternative, the kinetic energy of the ions can be adjusted to maintain a fixed velocity regardless of mass. For example, voltages of upstream ion optics (such as an ion lens) can be adjust in coordination with the ramping RF and DC potentials to compensate for velocity differences due to increasing mass.

Figure 8:
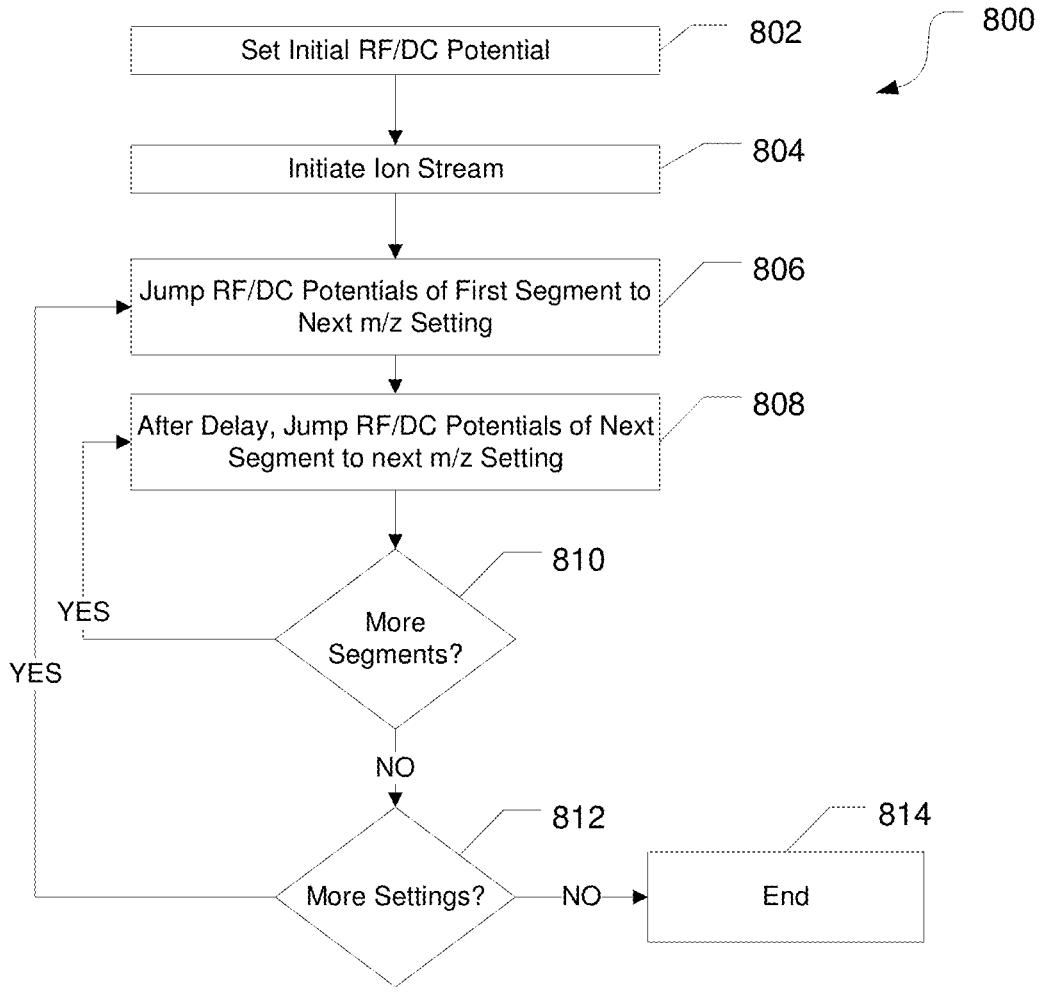
FIG. 8 is a flow diagram illustrating an exemplary method of operating a traveling wave quadrupole in SIM or SRM mode, in accordance with various embodiments.

FIG. 8 illustrates a method 800 scanning a mass range. At 802, the RF and DC potentials can be set to an initial value for all of the segments. At 804, an ion stream can be initiated. At 806, the RF and DC potentials of the first segment can be switched to a next target m/z. At 808, after a delay equivalent to the time required for ions to traverse the distance between segments, the RF and DC potentials of the second segment can be switched to the next target m/z. At 810, if there are additional segments, the method can return to 808 to switch the RF and DC potentials of a subsequent segment to the next target m/z after another delay. At 812, if there are more m/z targets, the method can return to 806 to switch the RF and DC potentials of the first segment to more m/z targets. When there are no more segments to switch and no more m/z targets, the method can end at 814.

Computer-Implemented System

Figure 9:
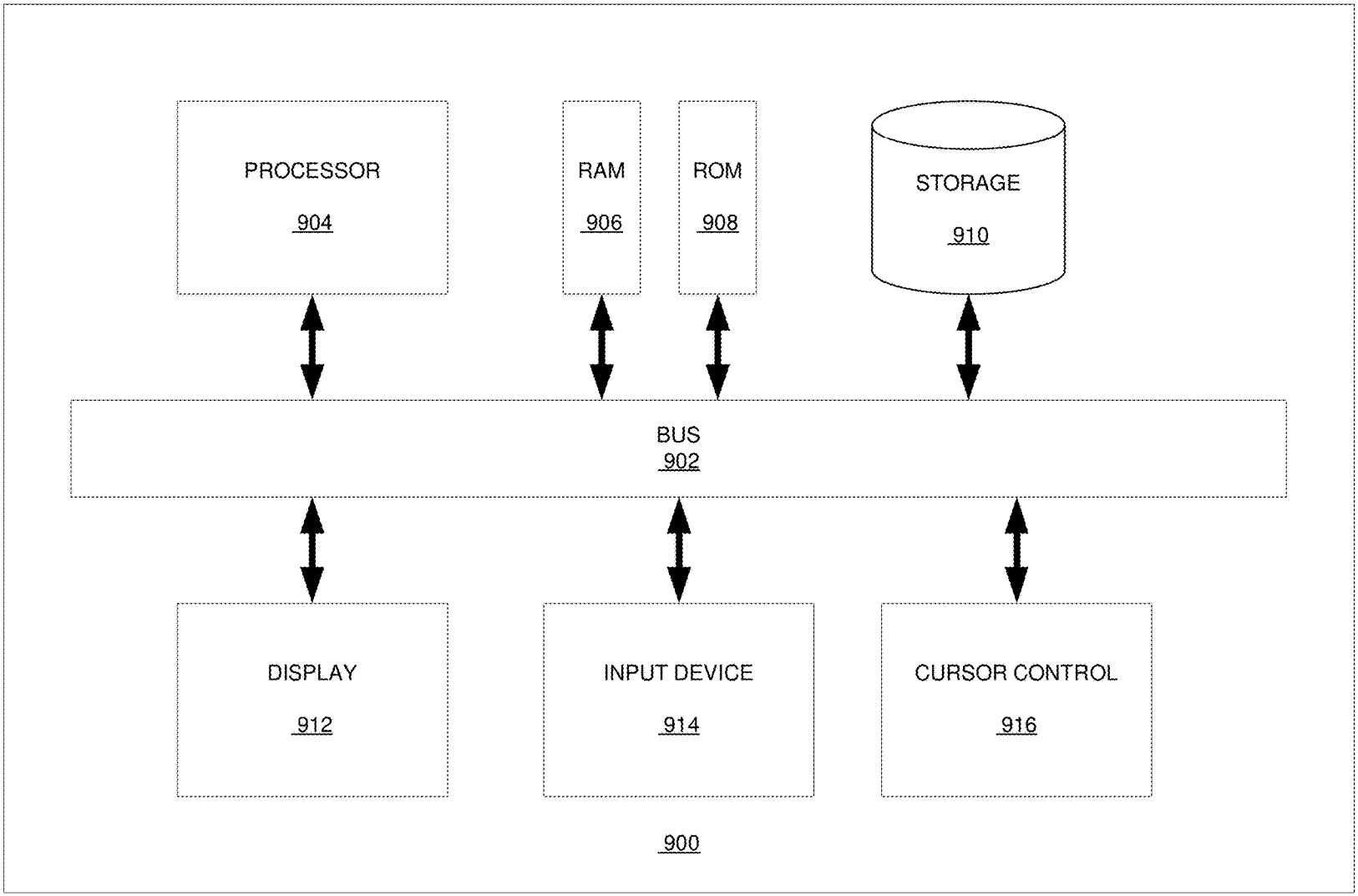
FIG. 9 is a block diagram illustrating an exemplary computer system, in accordance with various embodiments.

FIG. 9 is a block diagram that illustrates a computer system 900, upon which embodiments of the present teachings may be implemented as which may form all or part of controller 108 of mass spectrometry platform 100 depicted in FIG. 1. In various embodiments, computer system 900 can include a bus 902 or other communication mechanism for communicating information, and a processor 904 coupled with bus 902 for processing information. In various embodiments, computer system 900 can also include a memory 906, which can be a random access memory (RAM) or other dynamic storage device, coupled to bus 902 for determining base calls, and instructions to be executed by processor 904. Memory 906 also can be used for storing temporary variables or other intermediate information during execution of instructions to be executed by processor 904. In various embodiments, computer system 900 can further include a read only memory (ROM) 908 or other static storage device coupled to bus 902 for storing static information and instructions for processor 904. A storage device 910, such as a magnetic disk or optical disk, can be provided and coupled to bus 902 for storing information and instructions.

In various embodiments, computer system 900 can be coupled via bus 902 to a display 912, such as a cathode ray tube (CRT) or liquid crystal display (LCD), for displaying information to a computer user. An input device 914, including alphanumeric and other keys, can be coupled to bus 902 for communicating information and command selections to processor 904. Another type of user input device is a cursor control 916, such as a mouse, a trackball or cursor direction keys for communicating direction information and command selections to processor 904 and for controlling cursor movement on display 912. This input device typically has two degrees of freedom in two axes, a first axis (i.e., x) and a second axis (i.e., y), that allows the device to specify positions in a plane.

A computer system 900 can perform the present teachings. Consistent with certain implementations of the present teachings, results can be provided by computer system 900 in response to processor 904 executing one or more sequences of one or more instructions contained in memory 906. Such instructions can be read into memory 906 from another computer-readable medium, such as storage device 910. Execution of the sequences of instructions contained in memory 906 can cause processor 904 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus, implementations of the present teachings are not limited to any specific combination of hardware circuitry and software.

The term "computer-readable medium" as used herein refers to any media that participates in providing instructions to processor 904 for execution. Such a medium can take many forms, including but not limited to, non-volatile media, volatile media, and transmission media. Examples of non-volatile media can include, but are not limited to, optical or magnetic disks, such as storage device 910. Examples of volatile media can include, but are not limited to, dynamic memory, such as memory 906. Examples of transmission media can include, but are not limited to, coaxial cables, copper wire, and fiber optics, including the wires that comprise bus 902.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, G, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general-purpose computer selectively activated or configured by a computer program stored in the computer. In particular, various general-purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

What is claimed is:

1. A traveling wave multipole comprising:

two or more pairs of segmented electrodes arranged around a central axis; and a voltage supply configured to supply the segments of each pair of electrodes with a different RF and DC potentials; and match RF and DC potentials with a location of an ion of target m/z moving through the traveling wave multipole such that as the ion travels along the multipole the ion experiences the same RF and DC potentials while another ion of a second target m/z concurrently experiences a different RF and DC potentials at another location within the traveling wave multipole.

2. The traveling wave multipole of claim 1 wherein the voltage supply supplies a first segment of a first pair of electrodes with a first RF potential and a correspond segment of a second pair of electrodes with a second RF potential of opposite phase to the first RF potential.

3. The traveling wave multipole of claim 1 wherein the voltage supply supplies a first segment of a first pair of electrodes with a first DC potential and a correspond segment of a second pair of electrodes with the first DC potential.

4. The traveling wave multipole of claim 1 wherein the RF and DC potentials at a first segment are scanned across a mass range.

5. The traveling wave multipole of claim 1 wherein a resolution and a scan rate exceed a limit imposed by an ion transit time through the segmented multipole.

6. The traveling wave multipole of claim 1 wherein the RF and DC potentials at a first segment jump from a first transition to a second transition.

7. A method comprising:

supplying segments of a traveling wave multipole with RF and DC potentials, the traveling wave multipole including two or more pairs of segmented electrodes arranged around a central axis;

initiating an ion stream directed through the traveling wave multipole;

moving a first set of RF and DC potentials along the segments of the multipole at a rate matching an ion transit time of ions through the multipole to select ions within a first range of mass-to-charge ratios; and moving a second set of RF and DC potentials along the segments of the multipole at the rate matching the ion transit time of ions through the multipole to select ions within a second range of mass-to-charge ratios, wherein the first set of RF and DC potentials being applied to a first segment of the multipole concurrently with the second set of RF and DC potentials being applied to a second segment of the multipole.

8. The method of claim 7 wherein the first set of RF and DC potentials includes a first RF potential and a first DC potential applied to the first segment of a first pair of electrodes and a second RF potential and the first DC potential applied to the first segment of a second pair of electrodes, the second RF potential of opposite phase to the first RF potential.

9. The method of claim 8 wherein a resolution and scan rate exceed a limit imposed by an ion transit time through the multipole.

10. The method of claim 7 wherein the RF and DC potentials at a first segment are scanned across a mass range.

11. The method of claim 7 wherein the RF and DC potentials at a first segment jump from a first transition to a second transition.

12. A mass spectrometer comprising:

an ion source configured to produce an ion stream;

a traveling wave multipole including two or more pairs of segmented electrodes arranged around a central axis; and a voltage supply configured to supply the segments of each pair of electrodes with a different RF and DC potential; and moving a set of RF and DC potentials along the length of the traveling wave multipole at a rate matching an ion transit time of ions through the multipole thereby such that as the ion traveling along the multipole experiences the same RF and DC potential throughout the length of the multipole while another portion of the traveling wave multipole has a different set of RF and DC potentials.

13. The mass spectrometer of claim 12 further comprising an ion detector for detecting ions that pass through the multipole.

14. The mass spectrometer of claim 12 wherein the voltage supply supplies a first segment of a first pair of electrodes with a first RF potential and a correspond segment of a second pair of electrodes with a second RF potential of opposite phase to the first RF potential.

15. The mass spectrometer of claim 12 wherein a resolution and scan rate exceed a limit imposed by an ion transit time through the multipole.

16. The mass spectrometer of claim 15 wherein the RF and DC potentials at a first segment are scanned across a mass range.

17. The mass spectrometer of claim 12 wherein the RF and DC potentials at a first segment jump from a first transition to a second transition.

18. The mass spectrometer of claim 12 wherein the voltage supply supplies a first segment of a first pair of electrodes with a first RF potential and a correspond segment of a second pair of electrodes with a second RF potential of opposite phase to the first RF potential.

19. The mass spectrometer of claim 12 wherein the voltage supply supplies a first segment of a first pair of electrodes with a first DC potential and a correspond segment of a second pair of electrodes with the first DC potential.

* * * * *